US006694677B2

(12) United States Patent
Ortner

(10) Patent No.: US 6,694,677 B2
(45) Date of Patent: Feb. 24, 2004

(54) TRANSPORTABLE PODIUM

(76) Inventor: Wolfgang Ortner, Lustkandlstrasse 2, A-3061 Ollersbach (AT)

( * ) Notice: Subject to any disclaimer, the term of this patent is extended or adjusted under 35 U.S.C. 154(b) by 0 days.

(21) Appl. No.: 10/266,622

(22) Filed: Oct. 9, 2002

(65) Prior Publication Data

US 2003/0046875 A1 Mar. 13, 2003

Related U.S. Application Data

(63) Continuation of application No. 09/623,927, filed as application No. PCT/EP99/01745 on Mar. 17, 1999, now abandoned.

(30) Foreign Application Priority Data

Mar. 18, 1998 (DE) ..... 198 11 766

(51) Int. Cl.[7] ..... E04H 3/12

(52) U.S. Cl. ..... 52/9; 52/10; 52/143; 52/183; 297/257; 182/106

(58) Field of Search ..... 52/6–10, 182, 52/183, 188, 143; 297/331, 335, 344.18, 257, 236; 182/178.2, 106, 68.1

(56) References Cited

U.S. PATENT DOCUMENTS

| | | | | |
|---|---|---|---|---|
| 483,001 | A | 9/1892 | Hughes | 182/178.1 |
| 3,052,929 | A | 9/1962 | Busse | 52/10 |
| 3,107,398 | A | 10/1963 | Murphy | 52/9 |
| 3,335,533 | A | 8/1967 | Bahr | 52/188 |
| 3,885,827 | A | 5/1975 | Sanders | 296/64 |
| 3,995,832 | A | 12/1976 | Wiese | 256/59 |
| 4,571,895 | A | 2/1986 | Lyman, Jr. | 52/9 |
| 5,379,556 | A | 1/1995 | MacIntyre | 52/9 |
| 5,398,463 | A | 3/1995 | Wright | 52/7 |
| 5,459,964 | A | 10/1995 | Doublet | 52/8 |
| 5,559,411 | A | 9/1996 | Winship | 52/10 X |
| 5,661,928 | A | 9/1997 | Beu | 52/9 |
| 5,913,776 | A | 6/1999 | Compagnone | 52/10 |
| 5,950,373 | A | 9/1999 | Von Hoff et al. | 52/143 X |
| 5,979,125 | A | 11/1999 | Guillet | 52/143 |

FOREIGN PATENT DOCUMENTS

| | | | |
|---|---|---|---|
| DE | 7919671 U1 | 1/1980 | |
| DE | 3503769 A1 | 8/1986 | |
| DE | 3803823 | 8/1989 | |
| EP | 0091839 A1 | 10/1983 | |
| EP | 789118 A1 | 8/1997 | |
| FR | 2266783 | 10/1975 | |
| GB | 2108550 | 5/1983 | 52/9 |
| GB | 2174296 | 11/1986 | 52/9 |
| GB | 2206364 A | 1/1989 | |

*Primary Examiner*—Winnie S. Vip
(74) *Attorney, Agent, or Firm*—Venable, LLP; Catherine M. Voorhees

(57) ABSTRACT

The invention relates to a transportable podium (1) with step elements (2) which in an operating position of the podium (1) have different heights above a floor (6). To facilitate the assembly and disassembly of a mobile podium (1) the invention provides for the step elements (2) to be configured such that they can be extended telescopically and to be arranged in a substantially cuboidal support frame (5).

25 Claims, 6 Drawing Sheets

TRANSPORTABLE PODIUM

CROSS-REFERENCE TO RELATED APPLICATION

The instant application is a continuation of U.S. Ser. No. 09/623,927, filed Sep. 7, 2000 now is abandoned, which is a 371 of PCT/EP99/01745, filed Mar. 17, 1999.

BACKGROUND OF THE INVENTION

The invention relates to a transportable podium which is designed and suitable for use and erection at various locations, comprising step elements which, in an operating position of the podium, have different heights above a floor. The individual step elements are thereby either flat or step-shaped and can have connecting passages, seats or standing areas.

According to prior art, transportable podiums are erected from individual parts into a supporting scaffolding and dismounted into individual parts for transport. This has the consequence, that erecting and dismounting the known transportable podiums requires a considerable amount of time and assembly effort.

Stationary podiums are also known which can be pulled apart from a stack in the manner of a telescope along a horizontal pulling direction into the position of use and can be pushed back together into a stack, in opposition to the pulling direction, after use. Advantageously, these podiums can be erected with relatively little effort and, if the area they cover is needed for other purposes, they can be easily pushed back into a stack. These podiums are, however, stationary means which require an unacceptable amount of effort for transport to different locations of use.

Another telescopic podium provided for use at a fixed location, e.g. in a certain gymnasium, is disclosed in DE 7919671 U1. It comprises step elements having different heights above a floor during use. The step elements can be pulled apart in the manner of a telescope along a horizontal pulling direction into the position of use and can be pushed back together into a stack in opposition to the pulling direction.

This conventional podium comprises a chassis for transport thereof as a whole to facilitate erection and dismounting at the location of use when required without requiring any transport means. This podium can be pushed together in the manner of a telescope on the supporting frame connected to the chassis and moved to a different location using the chassis. Such a podium, provided for a certain location of use, has the advantage that it can be transported to the location of use if required. It is, however, not possible to transport these podiums to a different location, e.g. the gymnasium of another town, without an unreasonable amount of effort.

SUMMARY OF THE INVENTION

Taking into consideration the above prior art, it is the underlying purpose of the present invention to produce a transportable podium which can be easily erected, dismounted and transported from one location of use to another.

To achieve this object with a transportable podium comprising step elements having different heights above the floor during use of the podium, the invention proposes that the step elements can be pulled apart in the manner of a telescope along a horizontal pulling direction for use and can be pushed together into a pile in opposition to the pulling direction, and for transporting the podium to a different location, the piled step elements are arranged in a transporting position within an essentially cubical supporting frame or can be brought into a transporting position in the supporting frame by means of a lifting device.

The underlying idea of the invention consists in arranging step elements, which can be pulled apart and pushed together in the manner of a telescope and in a supporting frame which assumes a static function to support the podium during erection thereof and also for transporting the pushed together step elements. The supporting frame is essentially cuboid, i.e. its outer covering surface corresponds essentially to that of a cubical container. The supporting frame does not have to be formed as a closed receptacle, such as a container, but can be an open, supporting structure.

The feature that the step elements stacked in the transporting position are arranged within the supporting frame, means that, in the transporting position, they are essentially preferably completely within the space enclosed in the supporting frame. In the transporting position, the step elements are preferably suspended in the supporting frame. Also, additional fixing elements can be provided for fixing the position of the step elements in the supporting frame or load bearing supporting elements for supporting the step elements in the supporting frame from below.

The supporting frame is preferably an integrated part of the podium. It is preferably composed of profiles which are advantageously disposed along the edges of the essentially cuboid basic shape. Reinforcing braces and elements for securing the step elements in the transporting position must also be provided for as needed. The supporting frame thereby comprises a three-dimensional scaffolding as basic body for transport and erection of the podium. The braces are preferably erected in the floor and in the side parts of the cuboid supporting frame. Further braces can be erected in a transverse or longitudinal direction in the edge areas if they are disposed such that they do not obstruct pulling apart or lifting of the stacks.

For transporting the podium, the step elements are pushed into the supporting frame in which they are flush or slightly offset in a stack. It can thereby be advantageous to bring some of the stacking elements into a transporting position in the supporting frame by means of a lifting device.

For erecting the podiums, the step elements are preferably pushed out of the supporting frame via the longitudinal side of the supporting frame. It can be advantageous thereby if some of the step elements can be initially lifted by means of a lifting device above the upper side of the supporting frame and subsequently pulled out. The lifting device is preferably integrated in the cuboid supporting frame and can be realized e.g. by means of a spindle, chain or hydraulic drive. One embodiment is particularly preferred which comprises spindle drives preferably having synchronized gearing.

The inventive podium can provide standing areas and also seats on the step elements. The seats can be provided i.a. in the shape of individual seats, e.g. integral-molded seats which are erected e.g. on appropriate base structures on the step elements or are formed as folding seats. Particularly preferred are the seat elements of DE 3614983 A1.

The outer dimensions of the supporting frame can be selected as required by taking into consideration the transport requirements, the weight and the number of seats. An advantageous feature thereby can be that the outer dimensions of the supporting frame correspond essentially to an integral multiple or integral number of parts of the dimensions of standardized containers. This facilitates transport of such a standardized size. A 20 foot standardized container has e.g. a length of 6055 mm, a width of 2435 mm and a height of 2591 mm. An inventive supporting frame can have e.g. these dimensions or, with otherwise identical dimensions, only half or a third of the length.

In a further advantageous feature facilitating transport, the supporting frame comprises transport means for transport by means of a transporting device, lifting equipment or a conveying means. Transport means of this type can preferably be engagement elements in the form of loops or hooks, e.g. for erecting a crane hook or a crane gear. Other advantageous transporting means can be engagement openings, e.g. pockets for inserting a stacking fork for removing the container. Advantageously, the transporting means are generally disposed on top and/or on the side of the supporting frame. For transport with standardized transporting means, it can be in particular advantageous if the supporting frame comprises corresponding engagement openings, such as a container.

To obtain small transport weight, as many parts of the podium as possible preferably consist of light-weight material, e.g. of aluminium, especially the step elements. Supporting and load-receiving parts such as e.g. the supporting frame are preferably made from a stronger material.

It was surprisingly discovered within the scope of the present invention that the difficult requirements of transportable podiums can be solved by means of telescope-like extendable step elements arranged in a supporting frame without requiring time-consuming erecting or dismounting of many individual parts. The inventive podium not only has advantages with respect to the time required for erecting and dismounting and with respect to its mobility, but also has a wide range of uses.

A particular additional advantage of the inventive podium is that it does not need a solid, level, flat ground for erection. It can be erected on a sloping or uneven surface, since, for erecting the podium, it is sufficient to align the supporting frame in a horizontal direction, e.g. by using pivoting supports or spindles. The invention achieves goals which the experts have been attempting to achieve for a long time.

The following embodiments of the invention illustrate additional advantageous features and characteristics which are further described and explained by means of the representations shown in the drawing.

BRIEF DESCRIPTION OF THE DRAWINGS

The following embodiments of the invention illustrate additional advantageous features and characteristics which are further described and explained by means of the representations shown in the drawings.

DETAILED DESCRIPTION OF THE INVENTION

Figure 1:
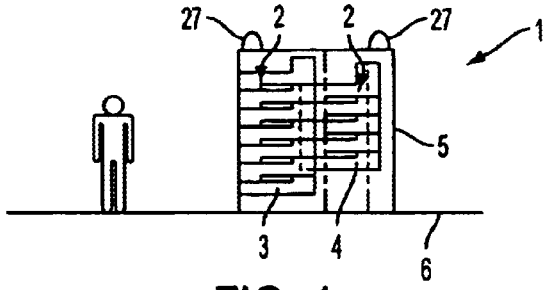
FIG. 1 shows a side view of a podium comprising step elements in the transporting position.

FIG. 1 shows a side view of an inventive podium 1 comprising step elements 2 in a stacked position. The step elements 2 comprise a front stack 3 and a rear stack 4. They are disposed in a supporting frame 5 surrounding the two stacks 3, 4. In other embodiments, only one of the two stacks 3, 4 can be provided. The supporting frame 5 is on the floor 6 or a different support surface and comprises securing elements (not shown) by means of which the step elements 2 are secured from inadvertent pulling out. The supporting frame 5 is formed inadvertent pulling out. The supporting frame 5 is formed preferably such that it can be piled on top of or next to one another for transport with other supporting frames. Transport means of this type can preferably be engagement elements in the form of loops or hooks 27.

Figure 2:
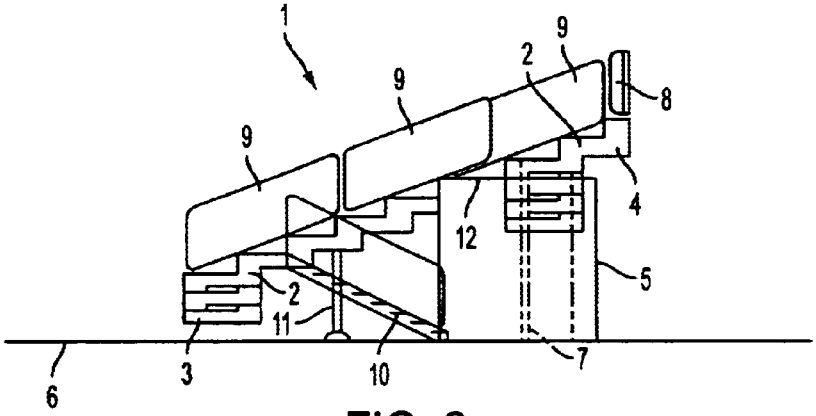
FIG. 2 shows a side view of the podium of FIG. 1 in a first position of use.

FIG. 2 shows the podium 1 of FIG. 1 in a first position of use. The step elements 2 of the front stack 3 are pulled out from the supporting frame 5 in a forward direction. The step elements 2 are partially pulled out in the manner of a telescope and form a front part of a podium 1. The not needed step elements 2 of the front stack 3 are stacked on top of one another and form the front end of the pulled out step elements 2. The upper step element 2 of the front stack 3 is connected to the supporting frame 5.

The podium 1 not only comprises a lower front stack 3, having step elements 2, which can be pulled out of the supporting frame 5 from the transport position in the forward direction, but also an upper rear stack 4, having step elements 2, which can be pulled out towards the rear from the supporting frame 5 departing at a position raised with respect to the transporting position. For pulling out the upper part of the podium 1, the rear stack 4 is partially lifted by means of a lifting device 7 formed by a spindle drive and the required step elements 2 are extended towards the rear in the manner of a telescope. The upper banister 8 is already erected to the uppermost step element 2 and must merely be folded out and arrested. The side banisters 9 are inserted into the step elements 2 and arrested. The present example also comprises stairs 10 extending downwards towards the rear.

The front part of the podium 1 formed by the step elements 2 of the stack 3, is supported on the floor 6 by means of a front supporting element 11. The rear part of the podium 1, formed by the step elements 2 of the rear stack 4, is unsupported, i.e. does not comprise a supporting element. This is possible in the example shown since the total depth of the podium 1, in particular the length of the extension in the upper part is relatively small. The podium 1 is erected in a first, short variant. The step elements 2 can be provided with seats as required. A further feature is that the supporting frame 5 forms part of a step of the podium 1 at its upper side. In FIG. 2, a suitable floor, e.g. a loadable board is erected in the area of the front edge 12 at the upper side of the supporting frame 5. The podium 1 thus forms an area or stairs which can be walked on from the bottom to the top.

Figure 3:
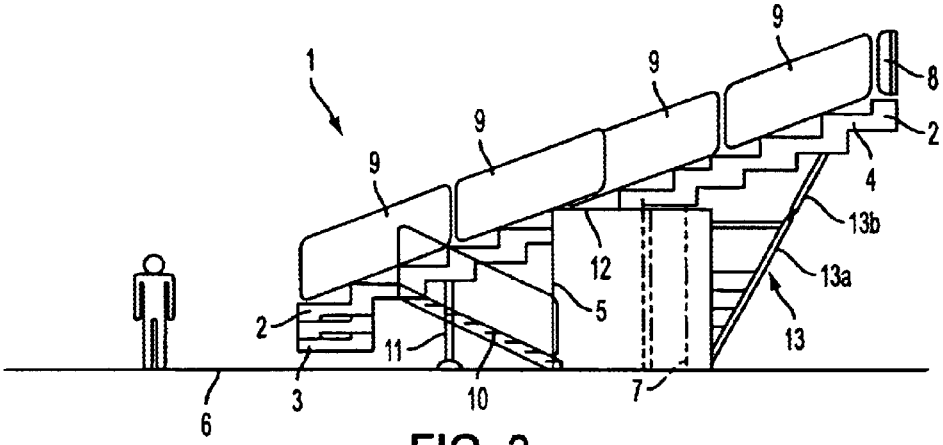
FIG. 3 shows a side view of the podium of FIG. 1 in a second position of use.

FIG. 3 shows a side view of the podium 1 of FIG. 2 in a further pulled-out position of use. The rear pile 4 is thereby completely lifted out of the supporting frame 5 by means of the lifting device 7. All of the step elements 2 of the rear stack 4 are pulled out in the manner of telescopes such that the rear part of the podium 1 has a larger erected depth and a larger number of walkable step elements 2. The front part, comprising the front stack 3, corresponds to the position of FIG. 2, however, can be pulled out to a greater or lesser degree.

The front part is supported directly on the floor 6 by a front supporting element 11. The front supporting element 11 serves for simultaneously supporting several step elements 2; not all step elements 2 of the front part of the podium 1 have their own support. The step elements 2 are connected by means of the telescopic guidance such that individual support of each step element 2 on the floor 6 is not required and the individual step elements 2 can accept mutual loads.

The rear part of the podium 1 comprises a rear supporting element 13 by means of which supporting elements 2 are borne on the supporting frame 5. It comprises a lower part 13*a* in the shape of a reinforced triangular frame which is pivotably hinged on the supporting frame 5 and an upper part 13*b* in the shape of a connecting rod which is screwed at its lower end to the lower part 13*a* and hinged with its upper end to a step element 2. The upper part 13*b* of the supporting element 13 and the front supporting element are advantageously hinged for pivoting at the step element 2.

Also in the upper part of the podium 1, not every step element 2 comprises a rear supporting element 13 for support on the floor 6 or the supporting frame 5, rather the step elements 2 are connected to one another by the telescopic guidance such that they can accept the required loads even without such a support. The rear supporting element 13 is formed like the front supporting element 11 for simultaneous support of several step elements 2, connected to one another in a telescopic manner.

Figure 4:
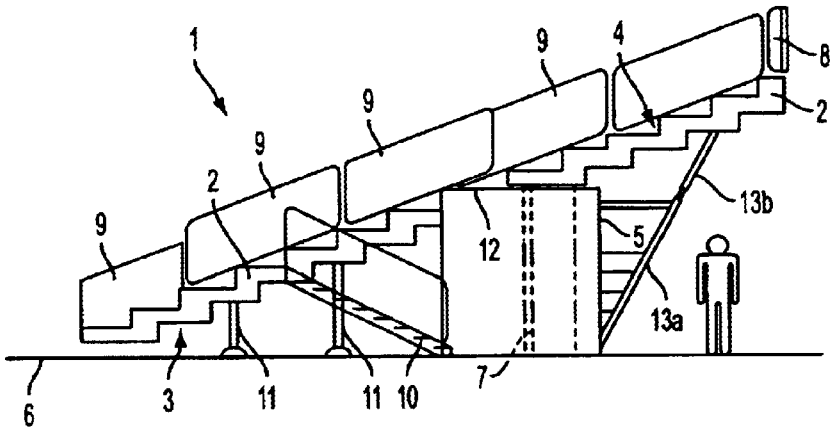
FIG. 4 shows a side view of the podium of FIG. 1 in a third position of use.

Advantageously, the inventive podium 1 can be erected in variable ways. FIG. 4 shows the podium 1 of FIGS. 2 and 3 in the position of use in which the two stacks 3, 4 are completely pulled out to thereby effect the largest possible number of step elements 2 for seats or standing areas. With respect to the construction of FIG. 3, the step elements 2 of the front stack 3 are completely pulled out. Due to the further extension to the front, a further supporting element 11 is provided for supporting the step elements 2 on the floor 6. The bottom step element 2 of the rear stack 4 is connected with the supporting frame 5 or the lifting device 7.

Figure 5:
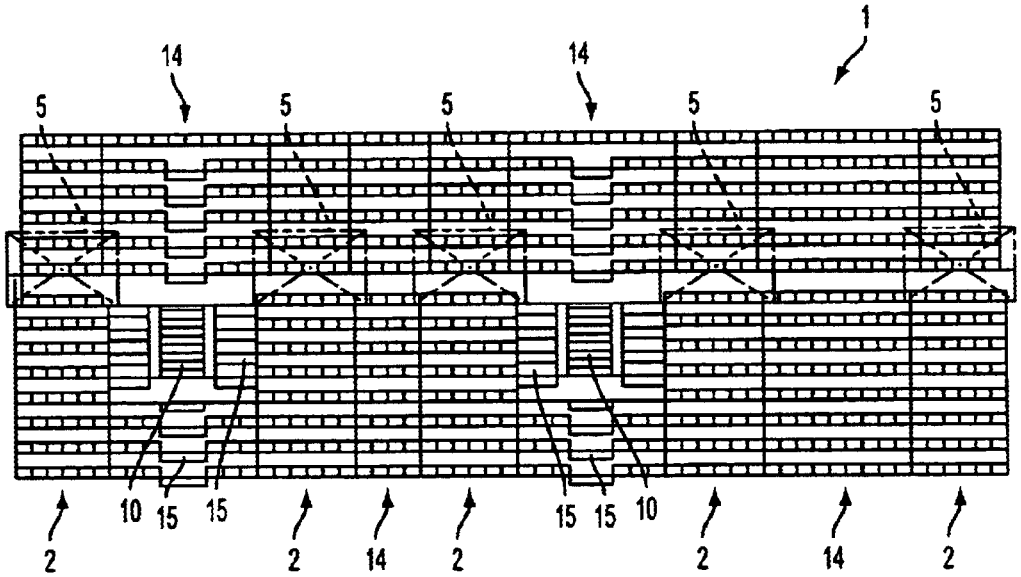
FIG. 5 shows a top view of the podium of FIG. 4.

FIG. 5 shows an exemplary top view of a podium 1 and FIG. 4 shows a side view thereof. It is constructed from a total of five adjacent supporting frames 5 which are disposed at a lateral distance from one another.

Connecting elements (explained in more detail in FIG. 11) are arranged on the side of the supporting frame 5 or the associated pulled-out step elements 2 and are connected with podium intermediate elements 14, each disposed between two neighboring supporting frames 5. The podium intermediate elements 14 are suspended parts which are hung-up between two neighboring supporting frames 5. The podium intermediate elements 14 can form step elements 2 or stair elements 10, 15. Steps which decline to the rear are designated with 10 and steps which decline to the front are designated with 15.

The podium intermediate elements 14, in particular those forming step elements 2 are preferably hung only on the laterally adjoining supporting frame 5 or the step elements 2 pulled out of the supporting frame 5 without supporting them with supporting elements on the floor 6 or the supporting frame 5. The podium intermediate elements 14 are then only erected to and supported on the neighboring supporting frames 5 or the step elements 2. This facilitates erecting and dismounting of the podium 1. The step elements 2 and the podium intermediate elements 14 are preferably of light-weight construction, e.g. made from aluminium.

FIG. 5 also shows that the podium 1 can be constructed in a plurality of ways in rows or sectors with or without cushions and with or without boxes by modified telescopic extensions and intermediate elements 14. For forming an angular or polygonal podium 1, intermediate segments formed of conically shaped podium intermediate elements 14 can also be provided between two neighboring supporting frames 5.

Figure 6:
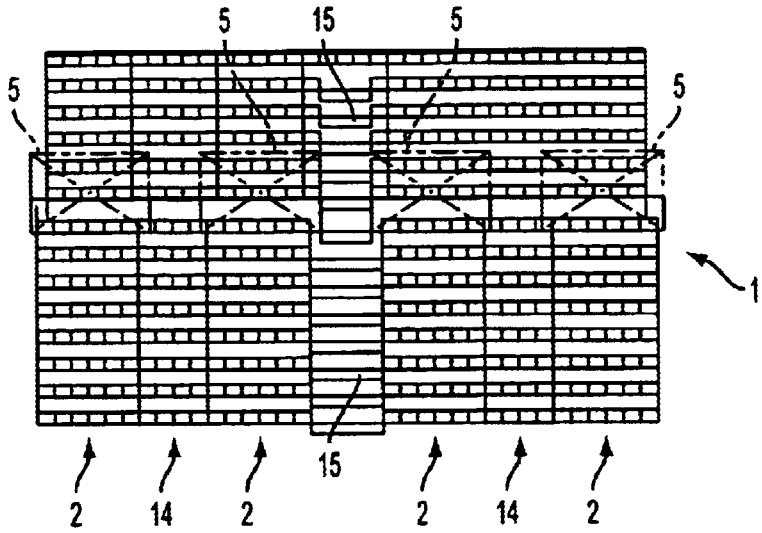
FIG. 6 shows a top view of a modified podium.
Figure 7:
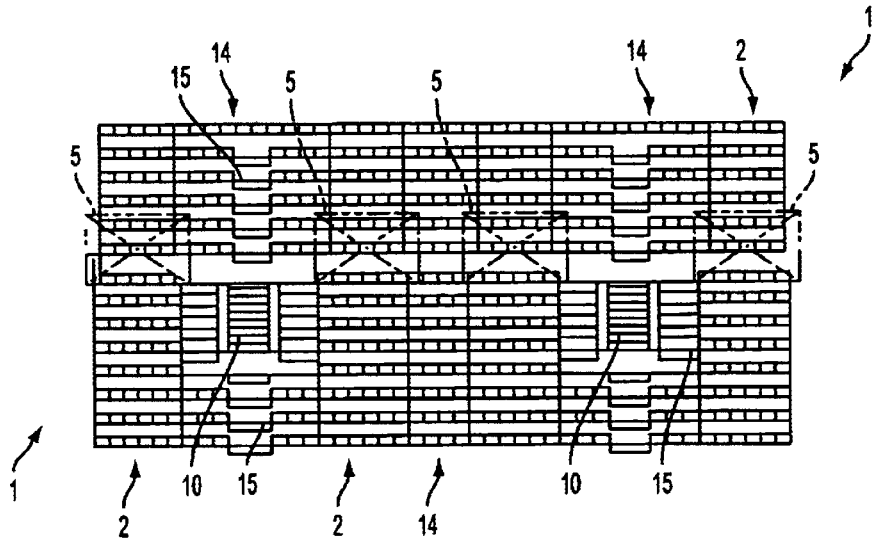
FIG. 7 shows a view of a further modified podium.

FIG. 6 shows a plan view of a different embodiment having a smaller number of seats. The podium 1 comprises four supporting frames 5 and only one staircase 15, towards the front. FIG. 7 shows a modification of a smaller podium 1 with only four supporting frames 5.

Figure 8:
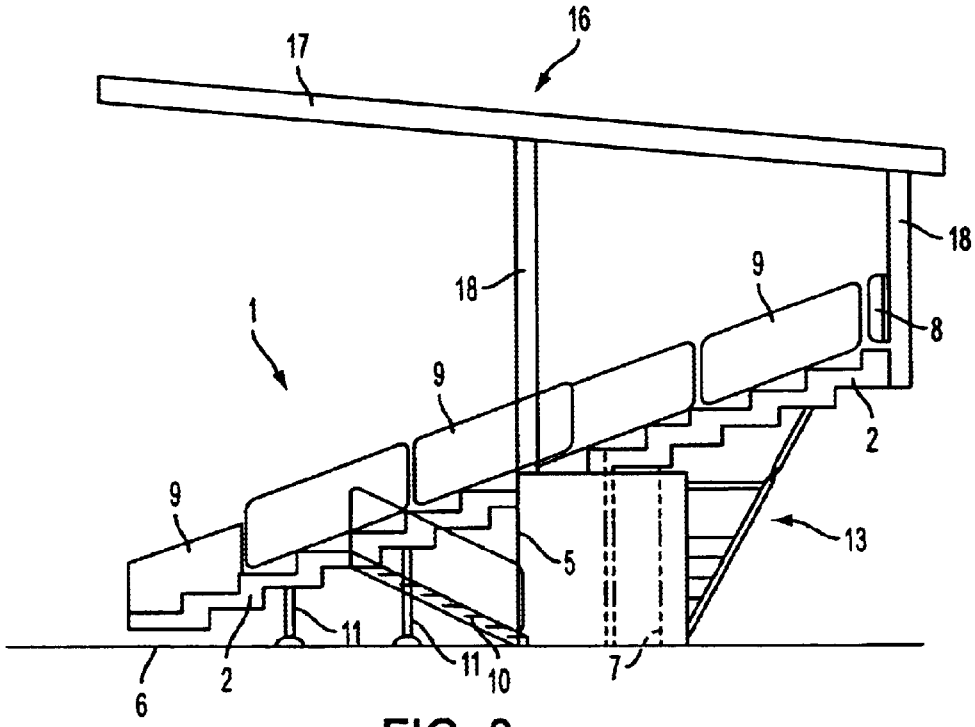
FIG. 8 shows a side view of a podium with roof.

FIG. 8 shows a side view of a podium 1 such as in FIG. 4 having a roofing 16 made from a textile roof skin 17 between purlins which are supported by roof supports 18 consisting of one or more parts. The roofing 16 can be erected to the podium 1 as required, wherein the roof supports 18 are supported e.g. on the corner points of the supporting frame 5 and on the upper podium ends in the area of the upper banister 8.

Figure 9:
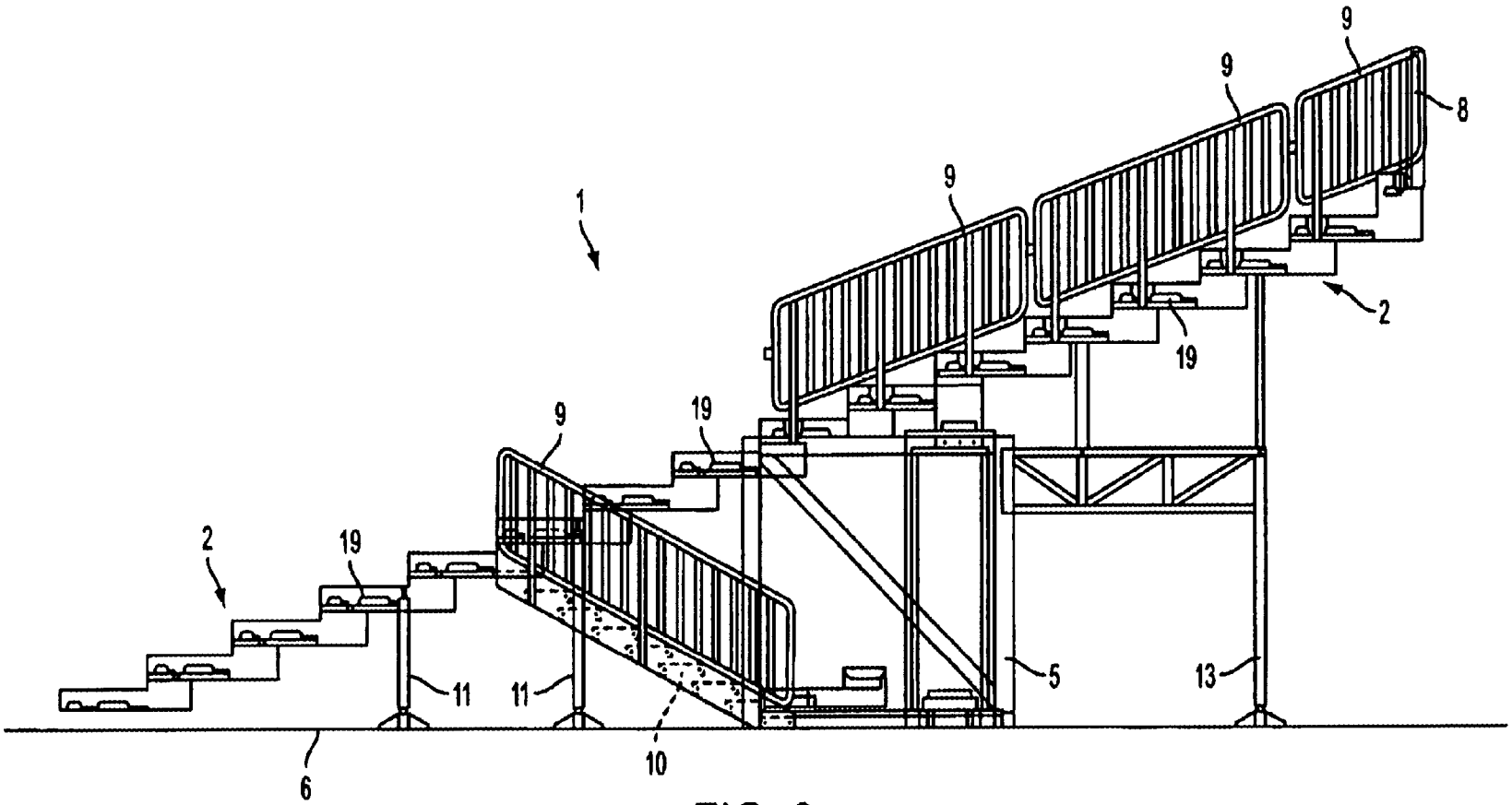
FIG. 9 shows a modification of FIG. 4.

FIG. 9 shows a modification of a podium 1 comprising a rear supporting element 13 which in contrast to the embodiment of FIG. 4, supports the upper part of the step elements 2 on the floor 6 instead on the supporting frame 5. This figure further shows the telescopic extension 19 between neighboring step elements 2. The guidance in the telescopic extensions 19 prevents tilting of the step elements 2 such that not every step element 2 must be supported on the floor 6 by supporting elements 11, 13.

Figure 10:
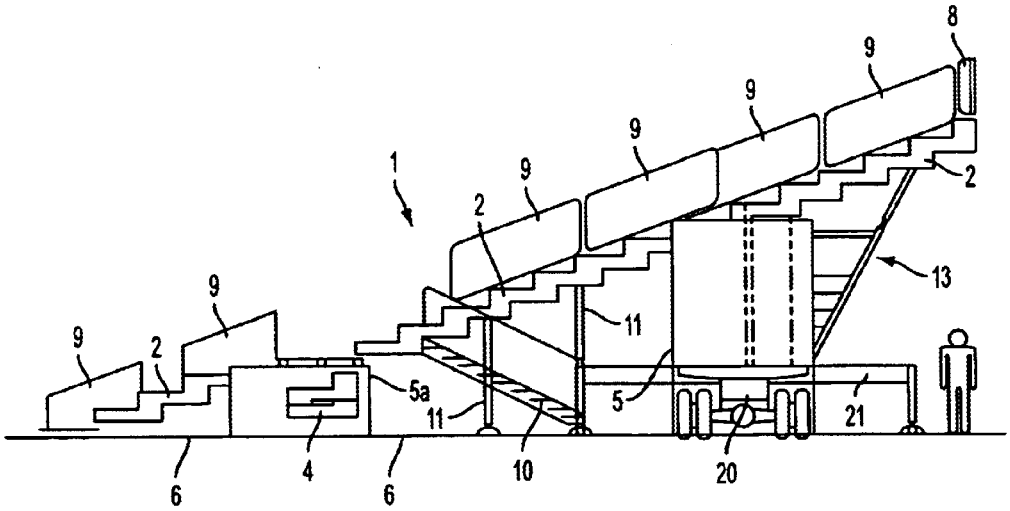
FIG. 10 shows a side view of a further podium.

FIG. 10 shows a side view of a podium 1 having the particular feature that it is formed of two mutually parallel supporting frames 5, 5*a* disposed at a separation with respect to one another and with their upper edge at different heights. The two supporting frames 5, 5*a* not only have different heights but also have different bases. The front supporting frame 5*a* is on the floor 6, whereas the rear higher supporting frame 5 is located on a base scaffolding. The base scaffolding can e.g. be a platform. Another embodiment of a suitable base scaffolding may be a carriage, chassis or a semitrailer 20 by means of which the supporting frame 5 can be transported with inserted step elements 2. For static reasons, lateral extensions 21 can be provided on the base scaffolding or the semitrailer 20 for support.

The podium 1 is formed by the two adjacent supporting frames 5, 5*a*, wherein in the embodiment shown, the step elements 2 are not lifted and extended out of the front supporting frame 5*a*. When the rear supporting frame 5 is located at a larger height or its front step elements 2 are only partially extended, the rear stack 4 of the front supporting frame 5*a* can also be used.

Figures 11, 12:
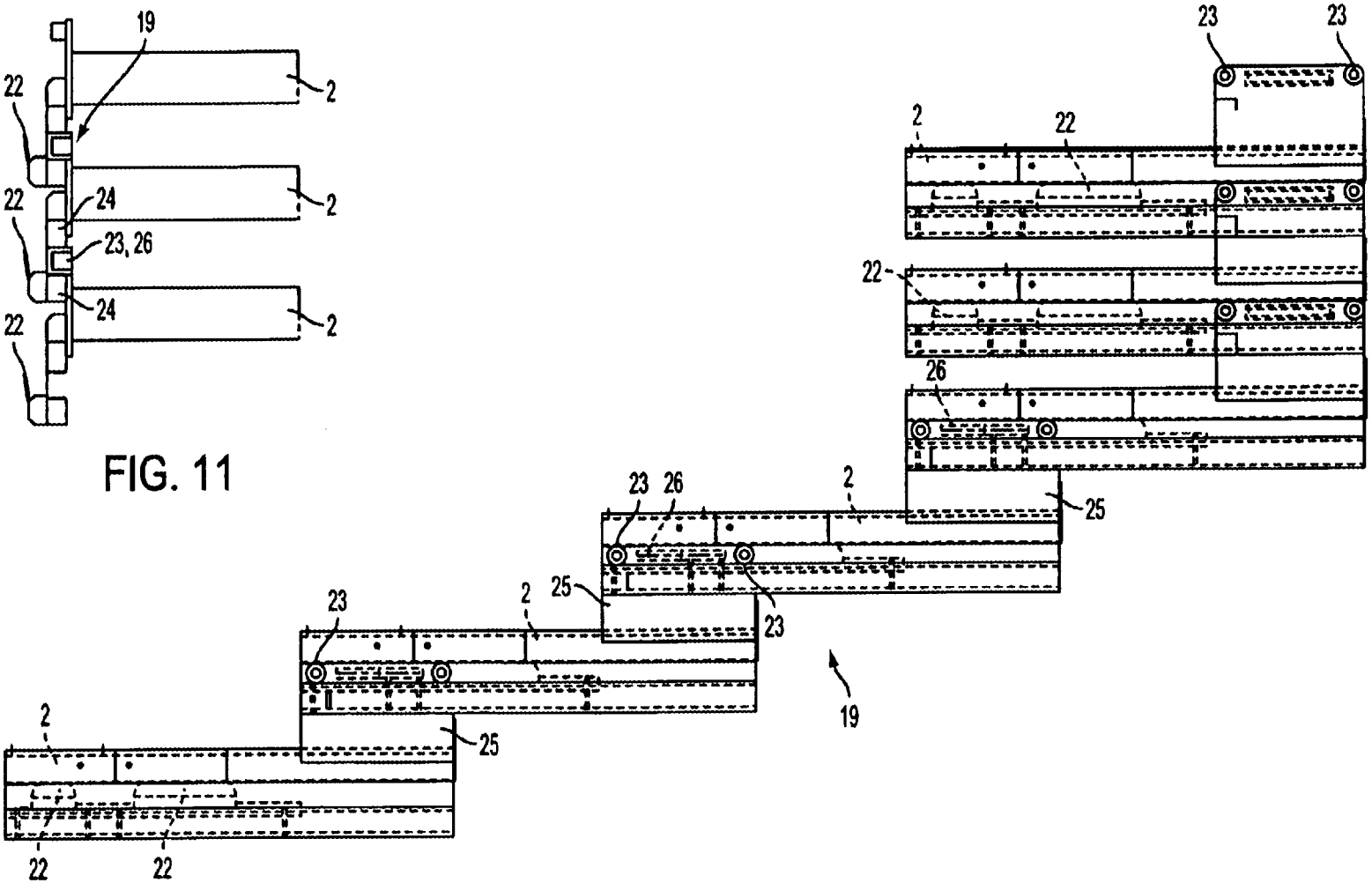
FIG. 11 shows a detail of the podium.
FIG. 12 shows a detail of the telescopic extension.

FIG. 11 shows, in partial section, details of the telescopic extension 19 and of the connecting elements 22 laterally erected on the step elements 2. The connecting elements 22 are formed as hang-up shackles into which podium intermediate elements are hung. Each telescopic extension 19 between two neighboring step elements 2 comprises rollers 23 and roller guides 24.

FIG. 12 shows details of the telescopic extension 19 in which three step elements 2 are located in the inserted piled position and three step elements 2 in the extended position. The telescopic extension 19 between two neighboring step elements 2 comprises two rollers 23 disposed at a separation from one another on the lower step element 2 on a shackle 25 which run in a roller guidance 24 disposed in the upper step element 2 and supporting the rollers 23 towards both the top and also the bottom.

The rollers 23 have end stops in the completely pulled out and also in the completely inserted positions of the step elements 2. For safety reasons, securing wedges 26 are provided each of which is disposed between two rollers 23 and are retained by the roller guidance 24 in case the roller 23 breaks such that, in this case, the step elements 2 do not become detached from one another, with the force and torque loading being ensured.

What is claimed is:

1. A transportable podium adapted for being transported to and erected at different locations of use comprising:

step elements having different heights above a ground during use of the podium, said step elements adapted to being pulled apart in a telescopic manner into a position of use by horizontally moving the step elements in a pulling direction and adapted to being pushed together by pushing said step elements in a pushing direction opposite to the pulling direction to form at least two stacks of step elements for transport to a different location;

at least one essentially cuboid supporting frame within which said step elements are stacked for storage and for transporting the podium to a different location for erection, wherein said essentially cuboid supporting frame serves as an integrated supporting frame for the step elements when the step elements are in a position of use; and a lifting device incorporated into said essentially cuboid supporting frame for lifting some of the step elements in a vertical direction prior to said some of the step elements being extended horizontally to a position of use, said lifting device bringing said some of the step elements within the essentially cuboid supporting frame for transport once said some of the step elements are retracted from the position of use wherein the step elements comprise a lower part and an upper part which respectively form a lower stack and an upper stack for transport to a different location, the lower part being extended from the transporting position out of the at least one essentially cuboid supporting frame towards the front, and the upper part having step elements which can be extended towards the rear of the at least one essentially cuboid supporting frame in a position lifted with respect to the transporting position.

2. The podium according to claim 1, wherein said some of the step elements can be lifted by the lifting device in a vertical direction past an upper side of the essentially cuboid supporting frame and subsequently pulled apart in the telescopic manner into the position of use.

3. The podium according to claim 1, wherein the step elements are essentially suspended in the at least one essentially cuboid supporting frame in the transporting position.

4. The podium according to claim 1, wherein a portion of said at least one essentially cuboid supporting frame is an incorporated member of the step elements when said transportable podium is in the position of use.

5. The podium according to claim 1, wherein outer dimensions of the at least one essentially cuboid supporting frame correspond to an essentially integral multiple or integral number of parts of the dimensions of standardized containers.

6. The podium according to claim 1, wherein the at least one essentially cuboid supporting frame comprises transport means for use with one of a transporting device, lifting equipment and a conveying means.

7. The podium according to claim 6, wherein the transport means comprise at least one of a loop-shaped engagement element and a hook-shaped engagement element.

8. The podium according to claim 6, wherein the transport means comprise at least one engagement opening.

9. The podium according to claim 6, wherein the transport means are disposed on at least one of a top and a side of the essentially cuboid supporting frame.

10. The podium according to claim 6, further comprising at least one supporting element for supporting the step elements in the pulled apart position of use.

11. The podium according to claim 10, wherein the at least one supporting element is formed for simultaneous support of several step elements.

12. The podium according to claim 10, wherein the step elements are directly supported on the floor by a supporting element of said at least one supporting element.

13. The podium according to claim 10, wherein the step elements are supported by a supporting element of said at least one supporting element on the essentially cuboid supporting frame.

14. The podium according to claim 10, wherein the supporting element is hinged in a pivotable manner on the supporting frame.

15. The podium according to claim 1, the at least one essentially cuboid supporting frame forms, on an upper side, part of a step element of the podium.

16. The podium according to claim 1, wherein the podium is formed of two or more at least one essentially cuboid supporting frames and the two or more essentially cuboid supporting frames are disposed parallel to one another at a separation with their upper edges having different heights.

17. The podium according to claim 16, further comprising connecting elements disposed laterally on said at least one essentially cuboid supporting frame, the connecting elements connecting intermediate podium elements, each of which is disposed between two neighboring supporting frames of said at least one essentially cuboid supporting frame.

18. The podium according to claim 16, further comprising connecting elements disposed laterally on a step element of the step elements, the connecting elements connecting intermediate podium elements, each of which is disposed between two neighboring supporting frames of said at least one essentially cuboid supporting frame.

19. The podium according to claim 17, wherein at least one podium intermediate element is a step element.

20. The podium according to claim 17, wherein at least one podium intermediate element is a stair element.

21. The podium according to claim 17, wherein the connecting elements are formed for suspending the podium intermediate elements.

22. The podium according to claim 17, wherein the podium intermediate elements are erected and supported only on one of a neighboring supporting frame of said at least one essentially cuboid supporting frame and associated step elements of a neighboring supporting frame of said at least one essentially cuboid supporting frame.

23. The podium according to claim 17, further comprises conically shaped intermediate segments having podium intermediate elements for forming an angular podium and a polygonal podium.

24. The podium according to claim 1, wherein the at least one essentially cuboid supporting frame is disposed on a base scaffolding.

25. The podium according to claim 24, wherein the base scaffolding is one of an undercarriage, a chassis, and a semitrailer.

* * * * *